US006133838A

United States Patent [19]

Meniere

[11] Patent Number: 6,133,838

[45] Date of Patent: Oct. 17, 2000

[54] SYSTEM FOR MONITORING A SWIMMING POOL TO PREVENT DROWNING ACCIDENTS

[75] Inventor: Jérôme Meniere, Neuilly-sur-Seine, France

[73] Assignee: Poseidon, Paris, France

[21] Appl. No.: 09/068,514

[22] PCT Filed: Nov. 13, 1996

[86] PCT No.: PCT/FR96/01789

§ 371 Date: May 12, 1998

§ 102(e) Date: May 12, 1998

[87] PCT Pub. No.: WO97/18542

PCT Pub. Date: May 22, 1997

[30] Foreign Application Priority Data

Nov. 16, 1995 [FR] France ..... 95 13585
Aug. 26, 1996 [FR] France ..... 96 10442

[51] Int. Cl.[7] ..... G08B 23/00

[52] U.S. Cl. ..... 340/573.6; 340/573.4; 340/566; 348/153; 348/159

[58] Field of Search ..... 340/573.6, 573.4, 340/573.1, 552, 553, 566; 367/93, 94; 348/408, 153, 159

[56] References Cited

U.S. PATENT DOCUMENTS

| | | | |
|---|---|---|---|
| 4,971,283 | 11/1990 | Tilsner | 248/231.9 |
| 5,043,705 | 8/1991 | Rooz et al. | 340/573.4 |
| 5,142,508 | 8/1992 | Mitchell et al. | 340/566 |
| 5,146,208 | 9/1992 | Parra | 340/573.6 |
| 5,195,060 | 3/1993 | Roll | 340/566 |
| 5,369,623 | 11/1994 | Zerangue | 340/573.6 |
| 5,574,497 | 11/1996 | Henderson et al. | 348/159 |
| 5,616,239 | 4/1997 | Wendell et al. | 210/86 |
| 5,691,777 | 11/1997 | Kassatly | 348/408 |

FOREIGN PATENT DOCUMENTS

| | | |
|---|---|---|
| 0 261 917 | 3/1988 | European Pat. Off. . |
| 0 485 735 | 5/1992 | European Pat. Off. . |
| 541637 | 12/1941 | United Kingdom . |
| 2 254 215 | 9/1992 | United Kingdom . |
| WO 95/34056 | 12/1995 | WIPO . |

*Primary Examiner*—Jeffery A. Hofsass
*Assistant Examiner*—John Tweel, Jr.
*Attorney, Agent, or Firm*—Young & Thompson

[57] ABSTRACT

A system for monitoring a swimming pool to prevent drowning accidents includes sensing devices (D1, D2, D3) for providing electrical signals forming images of bodies immersed in the pool water. Appropriate hardware (10) digitizes the resulting images, and the digital image data is compressed and stored at a series of times. Digitized images of a single body are compared at a series of times. The nature of a body, the path of the body and changes in the position of the body are estimated on the basis of the series of images; and an alarm is activated should the path or movement of the body being observed give cause for concern.

20 Claims, 3 Drawing Sheets

SYSTEM FOR MONITORING A SWIMMING POOL TO PREVENT DROWNING ACCIDENTS

The invention relates to a system for monitoring a swimming pool to prevent drowning accidents.

At present, the monitoring of swimming pools is either inexistent or is carried out by human monitoring. This type of monitoring is a difficult task which requires sustained attention and causes the individuals responsible for it, in particular swimming instructors, to suffer nervous fatigue. Indeed, further to the limitations inherent in any system relying on human intervention, for example loss of attention due to fatigue or temporary distraction, the monitoring of swimming pools is made very difficult because of the reflection of light from the surface of the water which is agitated, a phenomenon which makes it difficult to identify visually a motionless body at a depth of a few meters. The problem of monitoring swimming pools arises primarily for swimming pools which are open to the public.

The risk of drowning in a swimming pool occurs primarily when a bather is not sufficiently capable of swimming, for example in the case of a young child or when a swimmer faints.

In the first case, if the swimming pool is monitored, the swimming instructor or individuals close to the bather in distress have their attention attracted by the bather himself, in particular because he will wave his arms while trying to stay on the surface. In the second case, however, the swimmer will lose consciousness without attracting attention from those on duty or those nearby. There are generally two possible outcomes: either the bather exercises the respiratory movement by reflex, in which case his lungs will fill with water, leading to immediate loss of consciousness, or alternatively reflex apnoea will take place and some volume of air will stay trapped in the lungs. In general, a bather who has suffered this type of accident will sink to the bottom but, less commonly, he may also float unconscious in a characteristic position just below the surface of the water.

In the time when consciousness is lost, which marks the onset of drowning, an experienced lifeguard, in particular skilled in expired-air resuscitation, has about two to three minutes to give aid to the victim. If aid is given within this time, the victim will not generally suffer long-term affects from the accident, possibly after staying in hospital to clean out his lungs. In general, if aid is given between three and five minutes after consciousness has been lost, a time which nevertheless varies between individuals, the victim may still be saved but there is a risk of some irreversible damage, in particular to the brain. After five minutes, the risk of death becomes significant.

It has already been proposed, in U.S. Pat. No. 5,043,705, to use sonar for monitoring a swimming pool. According to this device, at least one sonar transmitter/receiver is provided on the bottom of the swimming pool, and a layer is monitored using this equipment. However, a device of this type has a considerable drawback because, in order to install the sonar and connect it to the processing equipment which derives information from the echoes which are received, it is necessary to route cables through the bottom of the swimming pool and below this bottom, which leads to an entirely prohibitive cost if the pool has already been constructed. Moreover, safety rules prohibit the use of voltages in excess of 12 or 24 volts, depending on the country, close to the water in a swimming pool, whereas it is necessary to use voltages of several hundred volts in order to generate sonar pulses. Furthermore, the signal obtained with sonar includes echoes due to the swimming pool walls, and it is extremely difficult to eliminate the noise signal thus obtained in order to make it possible to detect the signal corresponding to the submerged body of a drowning individual. In addition, sonar essentially makes it possible to identify the body of a drowning individual by the volume of air which it contains; if a victim has his lungs filled with water, the signal obtained will not at all conform with what might be expected, and may even not be identified by the signal processing. It will therefore be understood that a system of this type cannot be satisfactory.

It has also been proposed, in patent application WO 95/34056, to use cameras working in the visible wavelength range to monitor a swimming pool, these cameras being arranged in such a way that the observed region lies in a volume close to and parallel with the bottom of the swimming pool. In this device, the cameras only observe a layer of water parallel to the bottom, which means that the number of cameras needs to be increased if the bottom is not flat, as well as leaving most of the volume of the swimming pool unmonitored. Furthermore, this device does not make it possible to detect motionless bodies just below the surface of the water. Lastly, the cameras and their accessories are immersed in the swimming pool, which is unacceptable in terms of safety and causes considerable problems in connecting them to the signal processing equipment associated with them. This device cannot therefore be satisfactory.

The object of the invention is to provide a system for monitoring a swimming pool, which makes it possible to operate an alarm which automatically warns the monitoring staff promptly when the behaviour of a bather gives reason to suspect that he is at risk of drowning. A system of this type must be capable of detecting the start of a drowning accident, but it is also desirable to avoid false alarms by correctly analysing the behaviour of the swimmers, in particular to avoid a misinterpretation relating to the movement of a swimmer whose is intentionally diving and/or swimming under water. A further object of the invention is to describe a device of this type which can be installed without excessive costs in a swimming pool which has already been constructed. Another object of the invention is to describe a device of this type which is inaccessible to the users of the swimming pool and meets all safety requirements. A last object of the invention is to describe a device of this type which can be maintained and serviced easily without needing the swimming pool to be drained.

According to the invention, a system for monitoring a swimming pool to prevent drowning accidents, is characterized in that it comprises:

- detection means which can give, in the form of the electrical signals, images of bodies immersed in the water of the swimming pool, these detection means being provided on the walls of the swimming pool at points which are expediently distributed in order to scan at least a fraction of the volume of water in the swimming pool;
- means for digitizing the electrical signals which are obtained;
- means for compressing the digital data obtained by the aforementioned digitizing means;
- means for temporary and permanent storage of the digital data pertaining to images at successive times;
- means for comparing the digitized images pertaining to the same body at successive times;
- means for assessing the nature of a body (whether or not it is a human body), the path and changes in attitude of the body on the basis of these successive images; and decision means which can operate alarm means should the path or movement of the body being observed give cause for concern.

Preferably, each detection means comprises at least one video camera arranged in a watertight compartment supported by a side wall of the swimming pool, between the surface of the water in the swimming pool which is being used and the bottom of the said swimming pool; since the watertight compartment is below the surface of the water, provision may be made for an anti-moisture module to be arranged inside the said watertight compartment. Advantageously, the watertight compartment is immersed and contains two video cameras, the conical observation fields of which have an aperture angle of about 90°, and the axes of which are substantially orthogonal in a substantially horizontal plane.

Advantageously, use is made of means for multiplexing the electrical signals delivered by the detection means, these multiplexing means feeding the digitizing means; the said digitizing means and the means for compressing the digital data advantageously consist of a card for digitizing and compressing video images which is placed in a microcomputer with multimedia configuration.

The means for temporary and permanent storage of the digital data pertaining to images at successive times, the means for comparing the digitized images pertaining to the same body at successive times, the means for estimating the path and changes in attitude of a body and the decision means consist of the components of a microcomputer, in particular memory elements and the central processing unit of this microcomputer, in which suitable software has been loaded in order to allow it to perform the operations which have been indicated.

Advantageously, the digitizing means make it possible to digitize 25 images per second, these images being supplied by the detection means via the multiplexing means.

The means for comparing the digitized images between successive times are capable of taking into consideration only images whose dimensions correspond at least to those of a child, in order to exclude false alarms which may be caused by foreign bodies. These comparison means are furthermore designed to isolate a shape and track its path at successive times.

The estimation means are capable of determining, on the basis of the results of the comparison means, that a human body in the swimming pool is moving slowly and/or is motionless.

The decision means are capable of operating an alarm if the body in the swimming pool continues to move slowly or remains substantially motionless for more than a determined time, in particular more than 15 seconds.

Advantageously, the images which were used for the analyses leading to a warning being given are recorded on the hard disk of the microcomputer so that they can be consulted at any time.

Preferably, one or more monitor screens are arranged close to the seats of the swimming instructors or in the rooms of the staff in charge of monitoring the swimming pool, on which screens the images of a region considered as giving cause for concern are displayed.

The alarm may be given by an audible and/or visual warning device, in particular with an indication of the region of the swimming pool in which an event giving cause for concern is taking place.

It is possible to provide a device for immediately shutting down the pumping and filtration of the water in the swimming pool should an accident be detected, it being possible for this shutdown device to be controlled either manually or automatically by the microcomputer.

Advantageously, the detection means are each arranged in a watertight compartment, one wall of which consists of a globe having regions through which the information is acquired, making it possible to produce the images of the bodies immersed in the water in the swimming pool, and another wall of which is passed through in watertight fashion by cables which convey the information supplied by the detection means to outside the swimming pool. The wall through which the cables pass is equipped with a first removable watertight connector, connected to the first end of a watertight sheet whose other end is connected to a second watertight connector fixed to the end of a casing which passes in watertight fashion through the side wall of the swimming pool. Provision is preferably made that the interior of the casing is in communication with the water in the swimming pool, and that the leaktight sheath is coiled in the casing so as to have a length at least equal to that which makes it possible to remove the compartment from the water in the swimming pool without detaching the watertight connector fixed to the end of the casing.

Apart from the arrangements explained above, the invention consists of a certain number of other arrangements which will be dealt with more explicitly below with regard to a non-limiting illustrative embodiment which is described with reference to the appended drawing.

Figure 1:
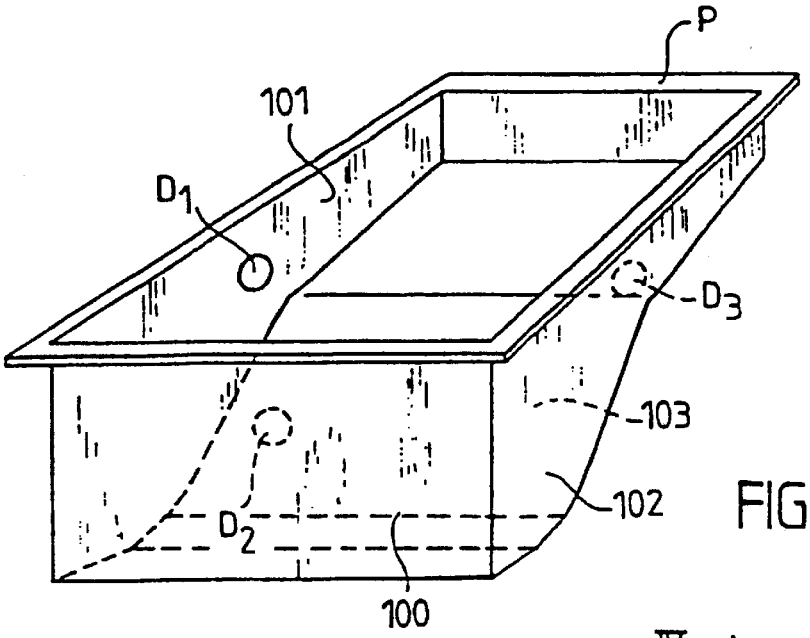
FIG. 1 is a schematic perspective view of a swimming pool equipped with the detection means of a monitoring system according to the invention.
Figure 2:
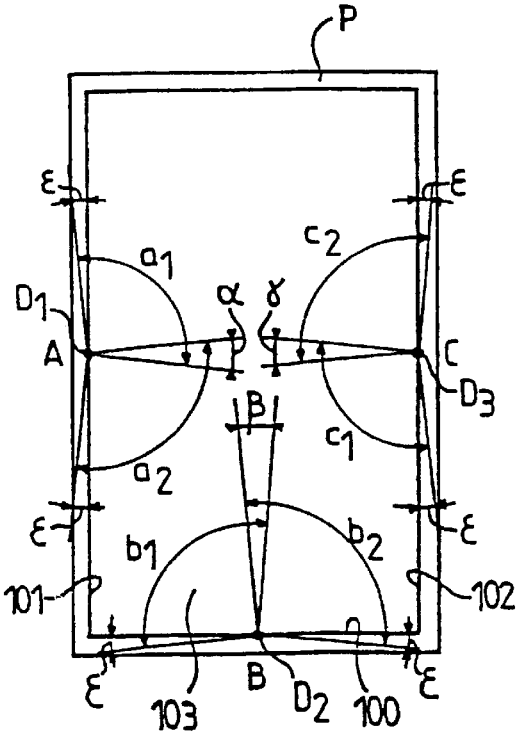
FIG. 2 is a schematic plan view of the swimming pool, illustrating the fields of view of the detection means which scan the entire volume of water in the swimming pool.
Figure 3:
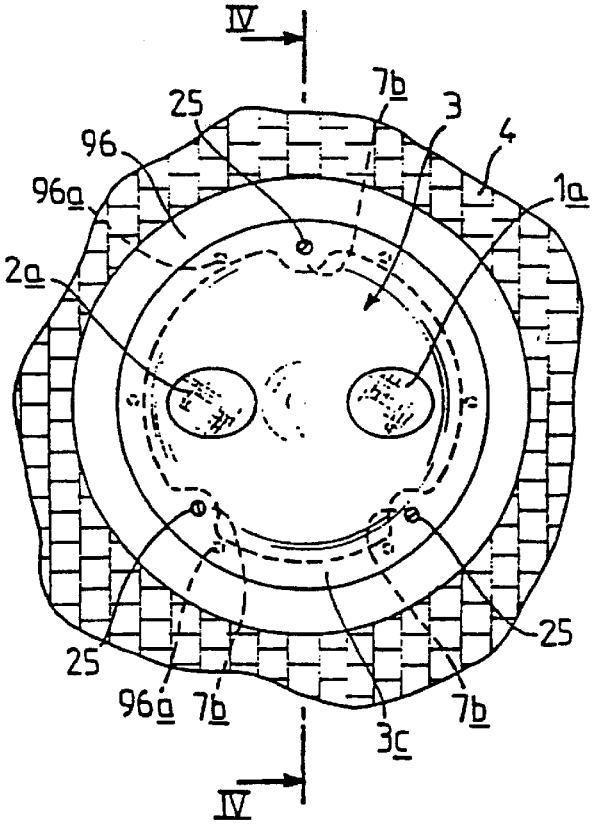
FIG. 3 is an elevation view of an immersed globe containing a detection means of the monitoring system according to the invention.
Figure 4:
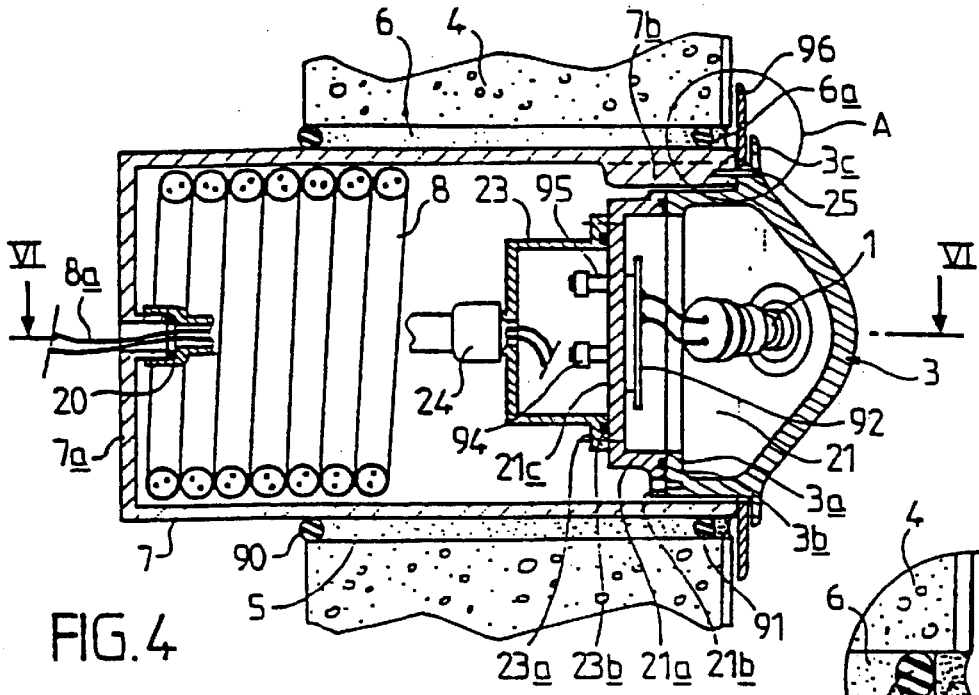
FIG. 4 is a view in section on the line IV—IV in FIG. 3.
Figure 5:
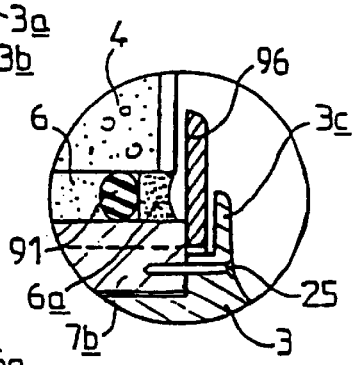
FIG. 5 is an enlarged view of the detail A in FIG. 4.
Figure 6:
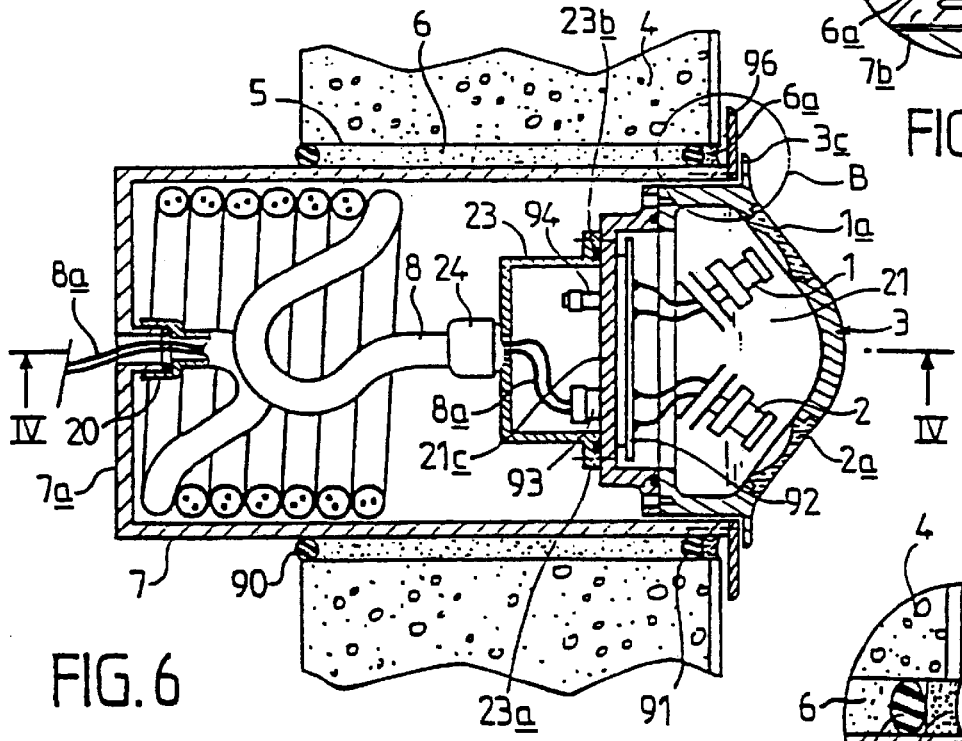
FIG. 6 is a view in section on the line VI—VI in FIG. 4.
Figure 7:
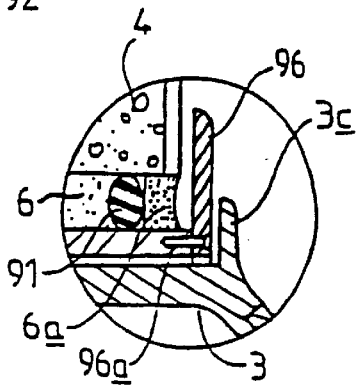
FIG. 7 is an enlarged view of the detail B in FIG. 6.
Figure 8:
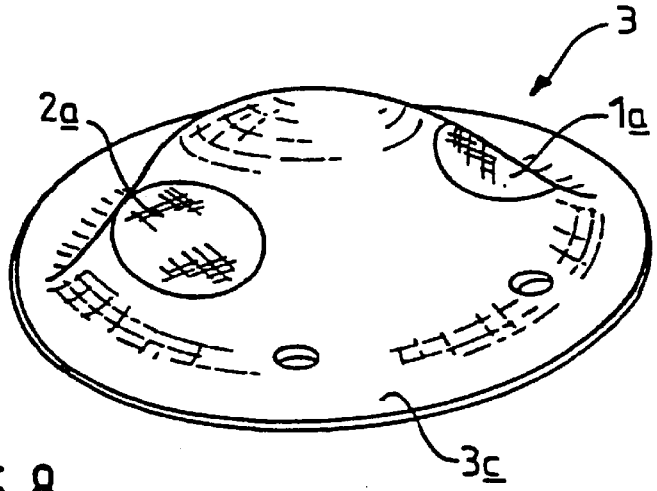
FIG. 8 is a perspective view of the globe in FIG. 3.
Figure 9:
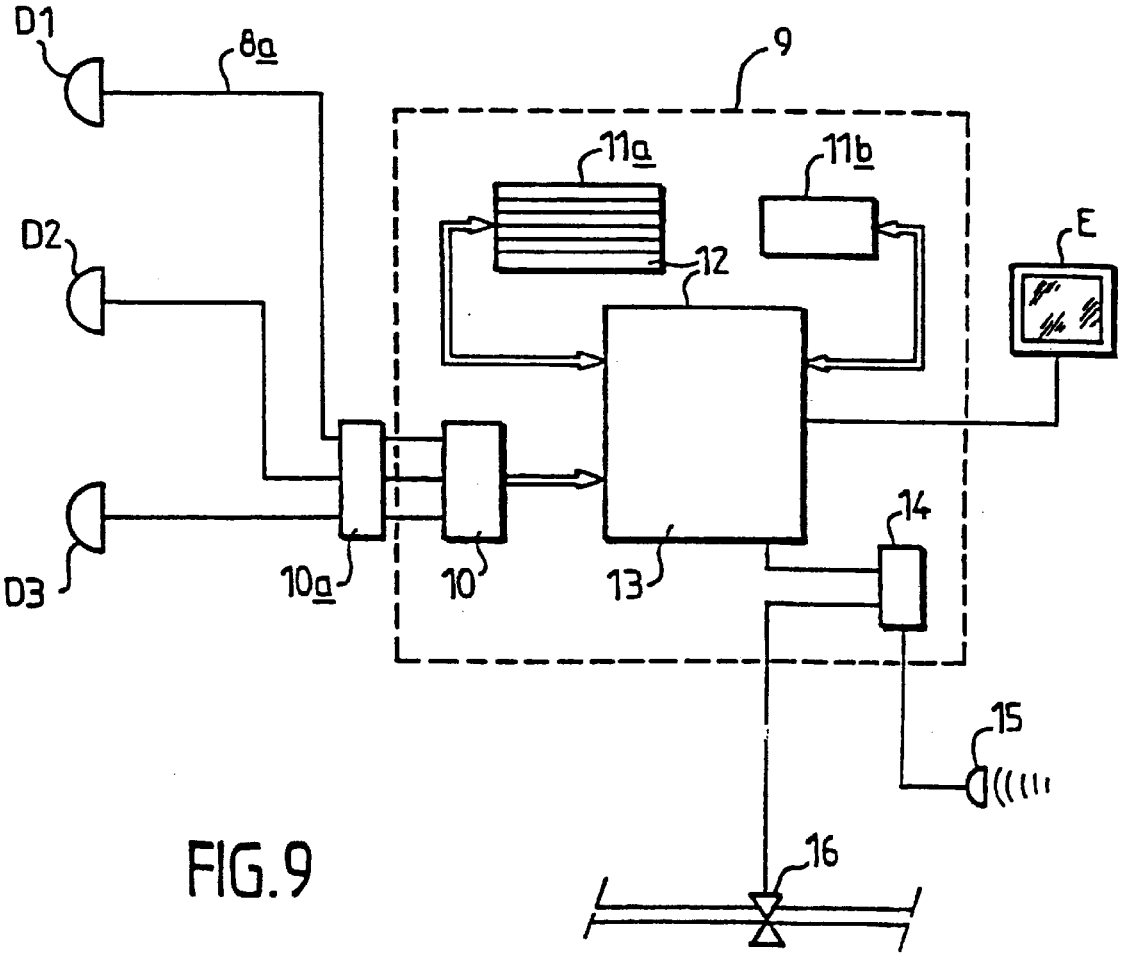
FIG. 9 is a simplified block diagram of the monitoring system.

As illustrated in FIG. 1, the system for monitoring a swimming pool P comprises detection means D1, D2, D3 provided on the walls of the swimming pool at points which are expediently distributed in order to scan the entire volume of water in the swimming pool. In the example in question, the three detection means D1, D2, D3 are arranged in the same horizontal plane, for example at a level of about 1.50 m below the level of the water in the swimming pool which is being used. As illustrated in FIG. 2, the detection means D1, D2, D3 are arranged in such a way that their fields of view partly overlap so as to leave no blind region and to scan substantially the entire volume of the swimming pool. An element or a body situated in the swimming pool will therefore be seen by at least two detection means D1, D2, D3.

These detection means are capable of producing, in the form of electrical signals, images of bodies immersed in the water of the swimming pool.

The detection means D1, D2, D3 are all identical and one of them, D1, will be described in detail below. The means D1 comprises two video cameras 1 and 2, preferably electronic cameras of the CCD type. The axes of the two cameras form an angle of 90° with one another and are symmetrical with respect to a plane which is perpendicular to the wall of the swimming pool and passes through the axis of the detection means. The aperture angle of the field of view of each of the cameras 1 and 2 is greater than 90°, and one of the borders of the field coincides approximately (seen in plan) with the pool side which supports the detector, so that, for the two cameras taken in combination, the field of view (seen in plan) is 180° with a central region α, β, γ respectively for the detection means D1, D2, D3 where there is an overlap between the fields of the two cameras. In the example which is described, the detection means D2 is supported by the side wall 100 of the swimming pool P adjacent to the deep end, at the point B on the said wall 100 lying in the longitudinal mid-plane of the swimming pool, whereas the detection means D1 and D3 are supported at A and C by the two longitudinal walls 101, 102 of the swimming pool, level with the inclined bottom region 103 joining the shallow end to the deep end, points A and C being in the vicinity of the transverse mid-plane of the swimming pool P. FIG. 2 schematically represents the observation cones of the two cameras of each detection means, denoting the cones of the cameras of the detection means D1 by a1, a2, those of the detection means D2 by b1, b2 and those of the detection means D3 by c1, c2. It can therefore be seen that the majority of the regions in the swimming pool are covered several times by the detection means: the monitoring takes place three-dimensionally since each camera has an observation cone, whereas in the prior art WO 95/34056, it was only possible to monitor a layer of water close to the bottom. Nevertheless, there are regions of water above and below each detection means which are covered only twice. The field of each camera encroaches by a small angle e on the pool side with which the said camera is associated, which reduces the lined regions that the observation by the cameras does not cover.

The cameras 1 and 2 are arranged in a globe 3 which is closed in watertight fashion and, as indicated below, is supported by the wall 4 of the swimming pool. A cylindrical duct 5 passes through this wall 4 and accommodates a cylindrical casing 7 containing a tubular sheath 8 in which the electrical cables 8*a* are arranged which connect the cameras 1 and 2 to the microcomputer 9 managing the system for monitoring the swimming pool. The sheath 8 is wound in a coil along the wall of the casing 7 and its ends are secured, by watertight connectors 20 and 24, respectively to the end 7*a* of the casing 7 and to a bell 23 associated with a compartment 21 which will be defined below. The compartment 21 is watertight; the bell 23 is attached in watertight fashion to the compartment 21; the interior of the bell 23 is connected to the exterior of the casing 7 by the sheath 8.

The two cameras 1 and 2 are oriented at about 90° relative to one another and their axes lie substantially in a horizontal plane. In the example in FIGS. 3 to 8, the globe 3 is rounded in order to avoid any injury to a swimmer who comes into contact with the said globe. The globe 3 is moulded from cast aluminium; in front of the cameras 1 and 2, it has two circular orifices where two lenses 1*a*, 2*a* are set in, these lenses cooperating with the objectives of the two cameras 1, 2 respectively to form "objective assemblies"; the rim of each lens forms a collar which is bonded adhesively into a circular recess of the globe. The lenses are made of high-strength glass to prevent any risk of damage; the design of the lenses 1*a*, 2*a* makes it possible to adapt the optical characteristics of the "objective assemblies" to the requirements of the system.

The duct 5 passing through the cycle 4 of the swimming pool is produced by boring; the cylindrical casing 7 is fitted in it and centring is carried out using two O-ring seals 90, 91. The seal 91 located next to the swimming pool has two holes, one in the vicinity of the bottom point and the other in the vicinity of the top point. A polymerizable resin is injected through the lower hole in order to form packing 6 between the duct 5 and the casing 7. After polymerization, the front face of the packing 6 is completed, on the side facing the swimming pool, by fitting a silicone seal 6*a*.

The casing 7 is intended to be filled by the water of the swimming pool. The cameras 1 and 2 are housed in the watertight compartment 21, one of the faces of which, on the side facing the swimming pool, consists of the globe 3, while the other face, on the side facing the end 7*a*, is defined by a cylindrical dish 21*a*, the free end of which supports a peripheral collar 21*b*. When the cameras have been installed in the compartment 21, the globe 3 is fixed on the collar 21*b* by means of screws which cooperate with threaded bushes fitted in bores which are provided through the thickness of the base 3*a* of the globe 3. Screwing the said screws in compresses an annular seal 3*b* which makes the assembly watertight. The bottom 21*c* of the dish 21*a* supports an electronics card 92 to which the output wires of the cameras 1 and 2 are connected. The output of the said electronics card passes in watertight fashion through the bottom 21*c* which, on its outer face, supports a female connector 93. The bottom 21*c* furthermore supports two valve connectors 94, 95 intended to cooperate with a nitrogen feed tube, on the one hand, and a venting tube on the other hand. It is thus possible, when the compartment 21 has been closed by attaching the globe 3 and the dish 21*a*, to create a dry nitrogen atmosphere in the interior of the compartment in order to prevent oxidation, increase the life of the CCD cameras and prevent any fogging problem; once the tubes have been disconnected, the valves of the connectors 94, 95 isolate the interior of the compartment 21 from the outside. The bell 23, which is secured to the bottom 21*c* by its shoulder 23*a*, is arranged on the bottom 21*c* outside the compartment 21; the shoulder 23*a* bears against the bottom 21*c* via an annular seal 23*b* which is compressed by screws.

Using screws 96*a*, a collar 96 is fixed on the flat end of the casing 7 on the opposite side from the end 7*a*, this collar 96 being intended to cover the border of the bore in which the casing 7 is arranged, as well as the region occupied by the packing 6. At its extremity on the opposite side from the end 7*a*, the casing 7 has three peripheral bosses 7*b* which protrude towards the axis of the casing 7; threaded bushes are inserted into these bosses which cooperate with screws 25; the heads of the screws 25 bear on the peripheral lip 3*c* of the globe 3. The watertight compartment 21 is thus held relative to the casing 7; however, because of the thickness of the globe 3 in the region where the screws 25 pass through it, a clearance has been formed between the collar 96 and the lip 3*c*; similarly, a clearance has been formed between the casing 7 and the part of the globe 3 which penetrates into it; the result of this is that the water from the swimming pool penetrates the casing 7 freely. It is therefore possible, from inside the swimming pool, to detach the chamber (3, 21, 21*a*, 23) from the casing 7 irrespective of the depth at which the detection means is located in the water of the swimming pool.

The bottom of the bell 23 supports a watertight connector 24 which fastens the sheath 8 on the bell 23. The electrical cables 8*a* are fitted into the sheath 8 before the bell 23 is fastened on the bottom 21*c* of the dish 21*a*, and the cables 8*a* emerge behind the end 7*a* of the casing 7, the end 7*a* being sealed at this feed-through by the watertight connector 20. The length of watertight sheath 8 provided between the watertight connectors 20 and 24 is sufficient for the chamber (3, 21, 21*a*, 23) to be detached from the wall of the swimming pool and placed at the edge of the swimming pool in order to carry out maintenance, repair or replacement. At the same time as the cables 8*a*, a preparatory thread, for example a nylon thread, is fitted into the sheath, this thread acting, in known fashion, as a "guide" intended to make it possible to introduce an additional or replacement cable into the sheath 8 without it being necessary to detach the connector 20 and therefore drain the pool: it is actually sufficient to attach the new cable and a new nylon thread "guide" behind the end 7*a*, take the chamber (3, 21, 21*a*, 23) out of the water, take off the bell 23, detach the connector 93, pull the nylon thread which is located there through the thus freed end of the sheath 8 until the new cable and the new "guide" appear, dispose of the said nylon thread constituting the initial "guide", connect the new cable which has been fitted in place on the connector 93, reattach the bell 23 on the dish 21*a*, lower the chamber (3, 21, 21*a*, 23) back under the water and fix it back on the face of the casing 7 using the screws 25.

Furthermore, the same set of screws 25 can be used to hold a closure cap (not shown) of the casing 7 when the compartment (3, 21, 21*a*) has been removed, the bell 23 having been fixed beforehand in watertight fashion on that one of the faces of the said cap which lies on the side facing the casing.

An anti-moisture module (not shown) is preferably provided inside the compartment 21.

The cables 8*a* which pass through the casing 7 are coaxial cables which, via multiplexing means 10*a*, are connected to a microcomputer 9, for example of the IBM compatible type, organized around a PENTIUM microprocessor [lacuna] on each cable 8*a*, a DC voltage is established which is intended to power the corresponding camera 1, 2, and the said camera sends a modulation on the cable 8*a*, this modulation constituting the signal to be processed. Before entering the multiplexing means 10*a*, the DC component is separated using the modulation means which deliver to the multiplexing means only the signal originating from the CCD type camera. The microcomputer 9 comprises a central processing unit 13, temporary storage means, or random-access memory 11*a*, permanent storage means, or hard disk 11*b*, and a remote-control card 14 which can control warning means 15 or valves 16; it is further connected to a monitor screen E, the said screen being a touch-sensitive screen allowing operational control. The microcomputer 9 has a multimedia configuration and is equipped with a video capture card 10 constituting means for digitizing the electrical signals delivered by the detection means D1, D2, D3, and means for compressing digital image data.

The images, in the form of electrical signals, are received via the demodulation means and the multiplexing means denoted 10*a* overall, at a rate of 25 images per second, by the video capture card 10 which converts them into digital images.

By virtue of the multiplexing, it is possible to process the detection means D1, D2, D3 with the same video card 10. It should be noted that the number of detection means treated by the same card could be greater than three and, for example, equal to eight.

Means 11 are provided for storing the digital data pertaining to images at successive times t, (t+1) etc. The storage means 11 consist of the memory means of the microcomputer 9, in particular internal random-access memory means 11*a* and the hard disk *b* of the computer.

Means 12 are provided for comparing the digitized images of the same body at successive times t and (t+1). The comparison means 12 are formed by the central processing unit 13 of the computer and suitable software stored in a range of the internal random-access memory 11*a*.

The time interval Dt between the two times t and (t+1) taken into consideration is sufficient, in the case of a swimmer's normal movement, for the differences between the two successive images to give evidence of this type of movement; the time interval Dt is, however, as small as possible so that a warning will be given without delay should the situation give cause for concern. This interval Dt may be of the order of a few tenths of a second.

Between two times t and (t+1) the comparison means calculate the differences between two matrices of successive images output by the same camera.

The comparison means thus make it possible to obtain the regions of change between two images at successive times, that is to say the regions of movement between the two times in question.

The central processing unit 13 combined with suitable software constitutes, further to the means for estimating the nature of a body whose image is obtained (whether or not it is a human body), the path and changes in attitude of this body. The central processing unit 13 and the software are furthermore intended to form decision means capable of operating an alarm should the path or movement of the body being observed give cause for alarm.

The software allowing the computer 9 and its central processing unit 13 to fulfil the functions mentioned above may correspond to various algorithms.

Because the matrix of the initial image (an empty swimming pool) is known, the various shapes moving in the pool which are picked up by the detection means can be counted and tracked individually.

Using the principle according to which knowledge of the derivative of a function and its initial value makes it possible to ascertain the function, it is possible to identify and track various shapes, corresponding to different bodies moving in the swimming pool, for example F1, F2 . . . Fn.

A correction is made on the shapes which are tracked, in particular in terms of size. This is because only those shapes whose dimensions correspond at least to those of a small child are considered. It is thus possible to exclude the images of inert objects, with small dimensions, and avoid false alarms.

The change in the path of the various shapes F1, F2 . . . Fn in the reference frame of the swimming pool is tracked. Should a movement give cause for concern, in particular in the event of a slow downward vertical movement which corresponds to passive sinking, or in the event of lack of motion at the bottom of the pool, or alternatively in the event of lack of motion just below the free surface of the water, the corresponding shape $F_i$ is set in prewarning status.

Expedient positioning of the detection means D1, D2, D3 relative to the bottom of the swimming pool ensures correct operation, with the entire swimming pool being covered by these detection means. A track shape F1 . . . Fn should ideally be able to disappear only "upwards", that is to say by leaving the lower region of the swimming pool by rising, or by leaving the swimming pool.

If, after a predetermined time interval, advantageously about 15 seconds, the tracked shape F1 has not changed from behaviour which gives cause for concern, that is to say if the lack of motion at the bottom or the slow vertical movement or the lack of motion close to the surface has continued for these 15 seconds without resuming a non-passive path, warning is given by the computer 9. The latter advantageously includes a remote-control card 14 capable of operating a variety of audible or visual warning means.

For example, the computer may operate a vibrator or buzzer 15, in particular worn on the belt of a swimming instructor responsible for monitoring the swimming pool. Furthermore, the region of the swimming pool where the event leading to the warning took place may be indicated on a liquid-crystal display screen, also carried by the swimming instructor, in the form of an alphanumeric code, so that the swimming instructor can quickly take action at the correct place.

Provision may furthermore be made for the computer 9 to cut off the valves 16 removing water from the swimming pool in the event of a warning, in order to stop any suction effect at the water output grills located at the bottom of the swimming pool. It is furthermore possible to have a facsimile message sent automatically to an emergency medical service.

Finally, the software which is used may make the microcomputer 9 store the digitized images of the incident on hard disk 11*b*.

The examples given above do not imply any limitation, and other means for giving warning may be used.

Furthermore, the images of the region where the movement giving cause for concern takes place, including a body being motionless at the bottom of the swimming pool, are displayed on at least one monitor screen E available to the monitoring staff.

With a system of this type, it is suitable to detect with absolute reliability all cases of movement giving cause for concern which may lead to a warning, but it is also necessary to avoid false alarms. For example, a shape consisting of a darker region in the bottom of the swimming pool may simply be a shadow of sufficient size created abruptly by the sun. A false alarm should be avoided in the case of this type.

The use of one or more sonars, in particular high-frequency active sonar, in the detection means D1, D2, D3 makes it possible to remove ambiguity of this type and, if appropriate, have secondary tracking of the paths of the shapes $F_i$ in the same sequence as the one mentioned with regard to detection means consisting essentially of cameras.

Detection means other than video cameras could be used, for example thermal cameras.

It might be possible to remove ambiguity relating to a detected shape using means other than a sonar, for example with a laser.

Whatever the alternative embodiment which is adopted, the monitoring system according to the invention makes it possible to improve the safety of swimming pools.

What is claimed is:

1. A system for monitoring a swimming pool to prevent drowning accidents, which comprises:

detection means (D1, D2, D3) comprising at least one video camera having a field of view, said at least one video camera being provided on a wall of the swimming pool in order to scan at least a fraction of the volume of water in the swimming pool, said video camera being adapted to give, in the form of electrical signals, images of bodies immersed in the water of the swimming pool;

whereby there is no echo due to said swimming pool walls generated by said at least one video camera;

means (10) for digitizing the electrical signals which are obtained from said at least one video camera;

means (11*a*, 11*b*) for temporary and permanent storage of the digital data pertaining to said images at successive times;

means (12, 13) for comparing the digitized images pertaining to the same body at successive times;

means (12, 13) for assessing the nature of a body as to whether it is a human body, and for assessing the path and changes in attitude of the body on the basis of these successive images; and decision means (12, 13) adapted to operate alarm means (15) should the path or movement of the body being observed give cause for concern.

2. A system for monitoring a swimming pool to prevent drowning accidents, which comprises:

detection means (D1, D2, D3) comprising a plurality of video cameras each of which has an observation cone directed in a different direction from the other observation cones of the other video cameras, said video cameras being distributed on at least one wall of the swimming pool with the observation cones of the various video cameras overlapping, said video cameras being adapted to give, in the form of electrical signals, images of bodies immersed in the water of the swimming pool;

whereby there is no echo due to said swimming pool walls generated by said video cameras;

means (10) for digitizing the electrical signals which are obtained from said video cameras;

means (11*a*, 11*b*) for temporary and permanent storage of the digital data pertaining to said images at successive times;

means (12, 13) for comparing the digitized images pertaining to the same body at successive times;

means (12, 13) for assessing the nature of a body as to whether it is a human body, and for assessing the path and changes in attitude of the body on the basis of these successive images; and decision means (12, 13) adapted to operate alarm means (15) should the path or movement of the body being observed give cause for concern.

3. System according to claim 1, characterized in that each detection means (D1, D2, D3) comprises at least one video camera (1, 2) arranged in a watertight compartment (21).

4. System according to claim 3, characterized in that the watertight compartment (21) is immersed and contains two video cameras, the conical observation fields of which have an aperture angle of about 90°, and the axes of which are substantially orthogonal in a substantially horizontal plane.

5. System according to claim 1, further comprising means (10) for compressing the digital data obtained by the aforementioned digitizing means, and the means for digitizing the images which are obtained and for compressing the digital data consist of a card (10) for digitizing and compressing video images which is placed in a microcomputer (9) with multimedia configuration.

6. System according to claim 1, characterized in that the detection means (D1, D2, D3) feed the digitizing means (10) via multiplexing means (10*a*).

7. System according to claim 1, characterized in that the means (11*a*, 11*b*) for storage of the digital data pertaining to images at successive times, the means for comparing the digitized images pertaining to the same body at successive times, the means for estimating the path and changes in attitude of a body and the decision means consist of the components of a microcomputer (9), in particular memory elements (11*a*, 11*b*) and the central processing unit (12, 13) of this microcomputer, in which suitable software has been loaded in order to allow it to perform the operations which have been indicated.

8. System according to claim 7, characterized in that the means (12, 13) for comparing the digitized images between successive times are capable of taking into consideration only images whose dimensions correspond at least to those of a child, in order to exclude false alarms which may be caused by foreign bodies.

9. System according to claim 7, characterized in that the comparison means (12, 13) are designed to isolate a shape and track its path at successive times.

10. System according to claim 7, characterized in that the estimation means (12, 13) are capable of determining, on the basis of the results of the comparison means, that a human body in the swimming pool is moving slowly and/or is motionless.

11. System according to claim 7, characterized in that the decision means (12, 13) are capable of operating an alarm if the body in the swimming pool continues to move slowly or remains substantially motionless for more than a determined time, in particular more than 15 seconds.

12. System according to claim 7, characterized in that the images which were used for the analyses leading to a warning being given are recorded on the hard disk (11*b*) of the microcomputer (9) so that they can be consulted at any time.

13. System according to claim 1, characterized in that at least one monitor screen (E) is accessible to the personnel monitoring the swimming pool, on which screen the images of a region considered as giving cause for concern are displayed.

14. System according to claim 1, characterized in that the alarm means comprise an audible and/or visual warning device (15), in particular with an indication of the region of the swimming pool in which an event giving cause for concern is taking place.

15. System according to claim 1, characterized in that it includes a device (16) for immediately shutting down the pumping and filtration of the water in the swimming pool should an accident be detected, it being possible for this shutdown device to be controlled either manually or automatically by the microcomputer (9, 14).

16. System according to claim 1, characterized in that the detection means (D1, D2, D3) are each arranged in a watertight compartment (21), one wall of which consists of a globe (3) having regions (1*a*, 2*a*) through which the information is acquired, making it possible to give the images of the bodies immersed in the water in the swimming pool, and another wall (23) of which is passed through in watertight fashion by cables (8*a*) which convey the information supplied by the detection means (D1, D2, D3) to outside the swimming pool.

17. System according to claim 16, characterized in that the wall (23) through which the cables (8*a*) pass is equipped with a first removable watertight connector (24) connected to the first end of a watertight sheath (8) whose other end is connected to a second watertight connector (20) fixed to the end (7*a*) of a casing (7) which passes in watertight fashion through the side wall (4) of the swimming pool.

18. System according to claim 17, characterized in that the interior of the casing (7) is in communication with the water in the swimming pool, and in that the leaktight sheath (8) is coiled in the casing (7) so as to have a length at least equal to that which makes it possible to remove the compartment (21) from the water in the swimming pool without detaching the watertight connector (20) fixed to the end (7*a*) of the casing (7).

19. Swimming pool equipped with the system according to claim 1, characterized in that the detection means (D1, D2, D3) are arranged in such a way that their fields of view partly overlap so as to leave no blind region and to scan substantially the entire volume of the swimming pool.

20. A system according to claim 2, in which said video cameras are fixed and are distributed about at least three walls of the swimming pool.

* * * * *